US010973336B2

(12) United States Patent
Kramer et al.

(10) Patent No.: US 10,973,336 B2
(45) Date of Patent: Apr. 13, 2021

(54) ADJUSTABLE SUPPORT LEGS FOR A MATTRESS FOUNDATION

(71) Applicant: Dreamwell, Ltd., Atlanta, GA (US)

(72) Inventors: Kenneth L. Kramer, Greensburg, IN (US); Jeffrey M. Woodall, Greenfield, IN (US); Francis Jan, Atlanta, GA (US); Brian Wiggins, Atlanta, GA (US)

(73) Assignee: DREAMWELL, LTD., Doraville, GA (US)

( * ) Notice: Subject to any disclaimer, the term of this patent is extended or adjusted under 35 U.S.C. 154(b) by 326 days.

(21) Appl. No.: 15/690,368

(22) Filed: Aug. 30, 2017

(65) Prior Publication Data

US 2019/0059601 A1 Feb. 28, 2019

(51) Int. Cl.
*A47C 19/04* (2006.01)
*A47C 19/02* (2006.01)
(Continued)

(52) U.S. Cl.
CPC ..... *A47C 19/045* (2013.01); *A47C 19/024* (2013.01); *A47C 19/025* (2013.01);
(Continued)

(58) Field of Classification Search
CPC ... A47C 19/045; A47C 19/024; A47C 19/025; A47C 19/04; A47C 20/04; A47C 20/021;
(Continued)

(56) References Cited

U.S. PATENT DOCUMENTS 3,503,082 A 3/1970 Kerwit
3,869,106 A * 3/1975 Gregov ..... A47B 95/043 248/345.1

(Continued)

FOREIGN PATENT DOCUMENTS

FR 2547185 A1 6/1983
GB 932478 A 7/1963
WO 2016204837 A1 12/2016

OTHER PUBLICATIONS

Wikipedia, "List of Polyurethane Applications", Aug. 10, 2015, p. 1 (Year: 2015).*

(Continued)

*Primary Examiner* — Nicholas F Polito
*Assistant Examiner* — Luke Hall
(74) *Attorney, Agent, or Firm* — Cantor Colburn LLP

(57) ABSTRACT

Mattress assemblies including static and adjustable mattress foundations generally include a foundation frame including side frame members and transverse frame members attached at respective ends by a corner bracket at each of the respective ends to define a generally rectangular shape. An adjustable support leg coupled to each one of the corner brackets for automatically elevating the foundation frame relative to ground. The adjustable support leg can include an outer tubular member fastened to an interior facing portion of the corner bracket including an end cap, wherein the end cap includes an aperture. A motorized linear actuator can be coupled to the outer tubular member, which can include a motor and an extendible portion coupled to the motor. The extendible portion is configured to selectively retract from and extend through the end cap to change the elevation of the foundation frame relative to ground.

1 Claim, 8 Drawing Sheets

(51) Int. Cl.
*A47C 20/04* (2006.01)
*A47C 20/08* (2006.01)

(52) U.S. Cl.
CPC ..... *A47C 19/04* (2013.01); *A47C 20/04* (2013.01); *A47C 20/08* (2013.01)

(58) Field of Classification Search
CPC ..... A47C 20/041; A47C 20/043; A47C 20/12; A47C 17/76; A47B 91/02; A61G 2203/723
USPC ..... 5/611, 663; 248/200, 220.1
See application file for complete search history.

(56) References Cited

U.S. PATENT DOCUMENTS 4,061,385 A * 12/1977 Schwartzberg ..... B60R 19/20 293/107
4,734,946 A * 4/1988 Saputo ..... A47C 27/085 5/201
5,090,070 A * 2/1992 Heinz ..... A61G 7/0509 5/313.1
5,285,995 A * 2/1994 Gonzalez ..... G05D 19/02 248/550
5,311,825 A * 5/1994 Bonham ..... A47B 95/043 108/27
5,469,589 A * 11/1995 Steed ..... A47C 19/005 5/201
5,544,375 A 8/1996 Urness et al.
5,621,933 A * 4/1997 Knapp ..... A61G 7/018 5/607
5,870,784 A 2/1999 Elliott
6,006,379 A 12/1999 Hensley
6,209,157 B1 * 4/2001 Hensley ..... A47C 20/041 5/613
6,393,641 B1 5/2002 Hensley
6,516,478 B2 * 2/2003 Cook ..... A47C 19/045 108/147
6,993,798 B1 * 2/2006 Roberts ..... A47C 17/80 5/118
7,036,166 B2 5/2006 Kramer et al.
7,305,727 B2 * 12/2007 Horlin ..... A47C 21/006 5/607
7,930,780 B2 4/2011 Clenet
D653,939 S * 2/2012 Roberts ..... D8/382
8,418,290 B2 4/2013 Shih
8,584,277 B1 * 11/2013 Roberts ..... A47C 19/005 5/400
8,640,285 B2 2/2014 Heimbrock et al.
8,806,682 B2 8/2014 Hornbach et al.
9,049,942 B2 6/2015 Huang
9,139,332 B1 * 9/2015 Roberts ..... B65D 19/0002
9,149,403 B2 * 10/2015 Turner ..... A61G 7/0514
9,474,383 B1 * 10/2016 Roberts ..... A47C 19/02
9,913,544 B1 * 3/2018 Weinschreider ..... A47C 19/045
D837,572 S * 1/2019 Roberts ..... D6/606
2002/0078500 A1 * 6/2002 Davis ..... A47C 17/80 5/118
2002/0174487 A1 * 11/2002 Kramer ..... A61G 7/015 5/618
2004/0199997 A1 * 10/2004 Harrow ..... A47C 19/021 5/201
2005/0028274 A1 * 2/2005 Hooper, Jr. ..... A47C 19/025 5/400
2006/0046021 A1 * 3/2006 Morris ..... B32B 5/06 428/99
2007/0271869 A1 * 11/2007 Andrikanich ..... E04F 19/022 52/656.1
2010/0154118 A1 * 6/2010 Pearce ..... A47C 19/005 5/201
2010/0319124 A1 * 12/2010 Turnbull ..... A47C 23/007 5/254
2014/0075674 A1 3/2014 Chun et al.
2014/0182058 A1 * 7/2014 Chandler ..... A47C 19/045 5/11
2016/0262548 A1 9/2016 Broom et al.
2017/0055715 A1 * 3/2017 Rohr ..... A47C 19/005
2017/0238716 A1 8/2017 Kramer
2018/0271279 A1 * 9/2018 Ozagir ..... E06C 7/44

OTHER PUBLICATIONS

TiMotion, "TA19 Data Sheet", Sep. 14, 2015 ((date of filing for U.S. Pat. No. 9,913,544)), pp. 1, 5 (Year: 2015).*
International Search Report dated Oct. 30, 2018 for Application No. PCT/US12/46010 (4 pages).
Written Opinion dated Oct. 30, 2018 for Application No. PCT/US12/46010 (10 pages).

* cited by examiner

ADJUSTABLE SUPPORT LEGS FOR A MATTRESS FOUNDATION

BACKGROUND

The present disclosure generally relates to mattress assemblies, and more particularly, to adjustable support legs for foundations for mattress assemblies.

Foundations for mattress assemblies are used in the healthcare field and in residential applications. A typical foundation includes a base and a mattress frame or support, which can be divided into a head and back section, an intermediate seat section, and a leg and foot section. Some foundations include adjustable sections, also referred to as articulating mattress assemblies, wherein the various mattress frame sections are pivotally interconnected and have a continuous range of adjustment. The sections are generally moveable from a flat, user resting position to a seated position with the legs bent or the legs straight and the patient's back angled upwardly with respect to the seat section. The sections are pivoted by motor drives, hand operated cranks or through the user's weight. Other foundations are generally static. That is, the various frame sections are not pivotally interconnected and are typically of a one piece construction providing a fixed horizontal and planar surface. The foundation itself, whether it is for an adjustable foundation or for a static foundation, is typically elevated at a fixed height relative to ground by support legs.

BRIEF SUMMARY

Disclosed herein are mattress assemblies and processes for adjusting a height of a foundation frame upon which a mattress is disposed. In one or more embodiments, a mattress assembly includes a foundation frame comprising side frame members and transverse frame members attached at respective ends by a corner bracket to define a generally rectangular shape; a deck supported by the foundation frame, the deck including a head and back section, an intermediate seat section, and a leg and foot section; and an adjustable support leg coupled to each one of the corner brackets, wherein each adjustable leg support is configured to independently change an elevation of the foundation frame relative to ground.

In one or more embodiments, an adjustable mattress assembly includes a foundation frame comprising side frame members and transverse frame members attached at respective ends by a corner bracket at each of the respective ends to define a generally rectangular shape; a deck supported by the foundation frame, the deck including a head and back section, an intermediate seat section, and a leg and foot section wherein the head and back section is hingedly connected to the intermediate seat section at one end and the leg and foot section is hingedly connected to the intermediate seat section at another end, wherein the intermediate seat section includes an upper panel and a lower panel spaced apart from the upper panel, wherein the lower panel is hingedly connected to the head and back section, and wherein the upper panel is stationary and hingedly connected to the leg and foot section; and a linkage assembly operative to independently effect inclination or declination of the head and back section and the leg and foot section relative to the lumbar section; and an adjustable support leg coupled to each one of the corner brackets for automatically elevating the foundation frame relative to ground, the adjustable support leg comprising an outer tubular member fastened to an interior facing portion of the corner bracket including an end cap, wherein the end cap includes an aperture; and a motorized linear actuator coupled to the outer tubular member, the motorized linear actuator including a motor and an extendible portion coupled to the motor, wherein the extendible portion is configured to selectively retract from and extend through the end cap to change the elevation of the foundation frame relative to ground.

In one or more embodiments, a process for adjusting a height of a mattress include lowering or raising adjustable support legs along a selected one or both of a longitudinal length of a foundation frame upon which a mattress is disposed, the adjustable support legs coupled to and configured to elevate the foundation frame relative to ground, the adjustable support leg comprising an outer tubular member fastened to the foundation frame; and a motorized linear actuator coupled to the outer tubular member, the motorized linear actuator including a motor and an extendible portion coupled to the motor, wherein the extendible portion is configured to selectively retract from and extend from the outer tubular member for adjusting the height of the foundation frame relative to ground.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Figure 1:
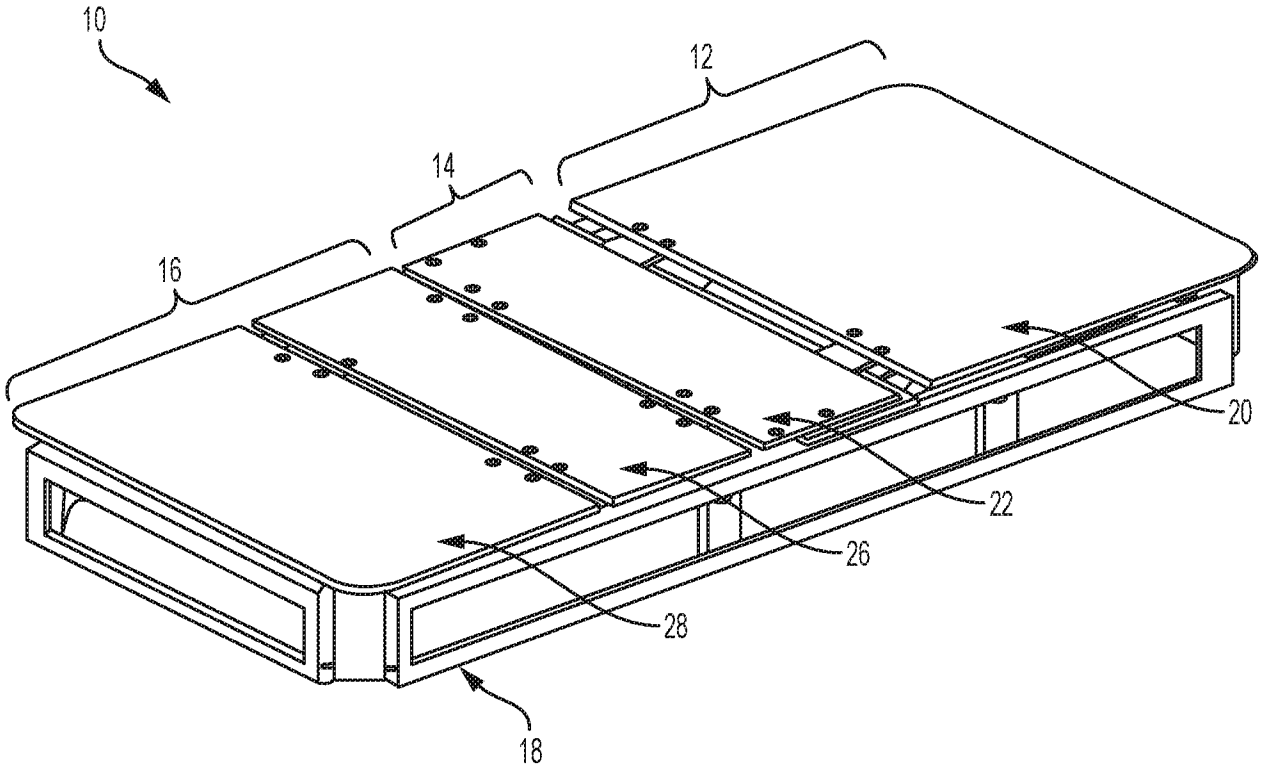
FIG. 1 ("FIG.") is a perspective view of an exemplary adjustable mattress foundation shown in a horizontal position in accordance with the present disclosure.
Figure 2:
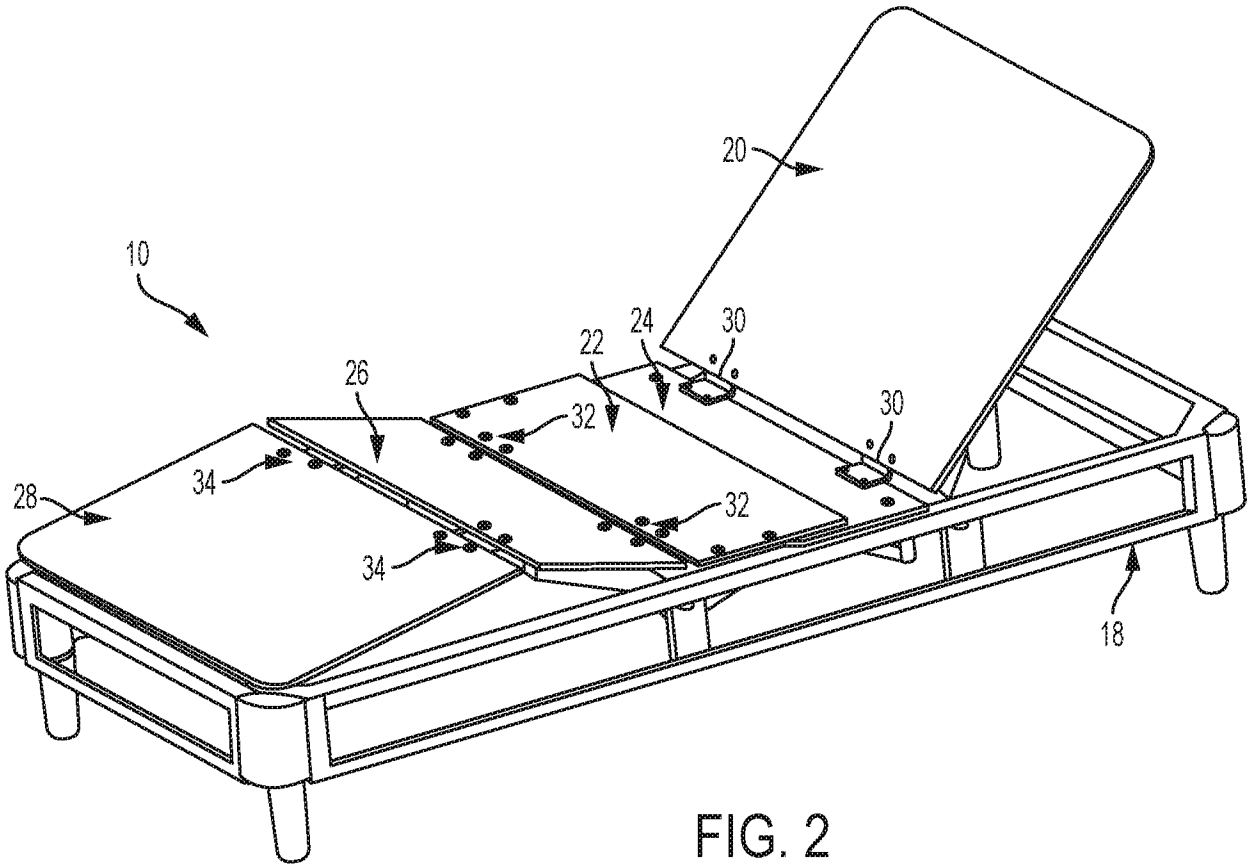
FIG. 2 is a perspective view of an exemplary adjustable mattress foundation shown in an inclined position in accordance with the present disclosure.

Referring now to FIGS. 1-2, there are shown perspective views of an exemplary adjustable mattress foundation 10 in accordance with the present disclosure. The adjustable foundation 10 includes adjustable support legs as will be described below for varying a height of the foundation relative to ground. Each adjustable support leg can be independently adjusted or two or more can be simultaneously adjusted. While reference herein is made to an adjustable foundation, it should be apparent that the adjustable support legs can be suitably utilized in static foundations, which are commonly used in residential applications, wherein the head, torso and foot sections are not incline-adjustable, are typically formed of a unitary member spanning the length and width of the foundation, and are configured to provide a stationary and horizontal mattress support surface for a generally planar mattress assembly thereon.

As is typical for adjustable mattress foundations, the adjustable mattress foundation 10 is movable between a fully horizontal position as shown in FIG. 1 and an inclined position as shown in FIG. 2. The different positions are typically defined by a head and back section 12, a leg and foot section 16, and an intermediate seat section 14 therebetween, wherein the head and back section 12 and the leg and foot section 16 can articulate, i.e., elevate, relative to the intermediate seat section 14. The different sections, 12, 14, and 16 collectively form a mattress support surface upon which a mattress (not shown) is disposed. In the illustrated inclined position shown in FIG. 2, which is exemplary and not intended to be limiting, the head and back section 12 and the leg and foot section 16 are shown elevated relative to the intermediate seat section 14. An operator or user may lie prone on a mattress disposed on the adjustable mattress foundation 10 in its fully horizontal position, in the fully inclined position, or in any position therebetween. The adjustable mattress foundation 10 generally includes a rectangular shaped foundation frame 18, which supports and elevates the head and back section 12 and the leg and foot section 16, and the intermediate seat section 14, relative to ground.

The head and back section 12 can be formed of a single panel 20 whereas the intermediate seat section 14 as well as the leg and foot section 16 can be formed of two panels 22, 24 and 26, 28, respectively, as shown more clearly in FIG. 2. Panel 20 of the head section 12 is hingedly connected via hinges 30 to lower panel 24 of the intermediate seat section 14 at one end thereof. Likewise, the leg and foot section 16 includes panel 26 hingedly connected at one end via hinges 32 to panel 22 of the intermediate seat section 14 and at another end to panel 26 of the leg and foot section 16 via hinges 34, wherein panels 22, 24 of the intermediate seat section 14 are in a sliding relationship to selectively increase or decrease length of the intermediate section upon inclination or declination of the head section 12 and/or the leg and foot section 16. In the intermediate section 14, panel 22 is an upper panel and panel 24 is the lower panel. Additionally, panels 26 and 28 of the leg and foot section 18 are hingedly connected to one another via hinges 34.

The different sections 12, 14, and 16 are supported on a generally rectangular foundation frame 18, which includes a linkage assembly (not shown) operable to selectively articulate the sections 12 and 16 relative to section 14 of the mattress support surface. The linkage assembly is not intended to be limited. An exemplary linkage assembly and adjustable foundation is described in U.S. Pat. No. 5,870,784, incorporated herein by reference in its entirety.

Figure 3:
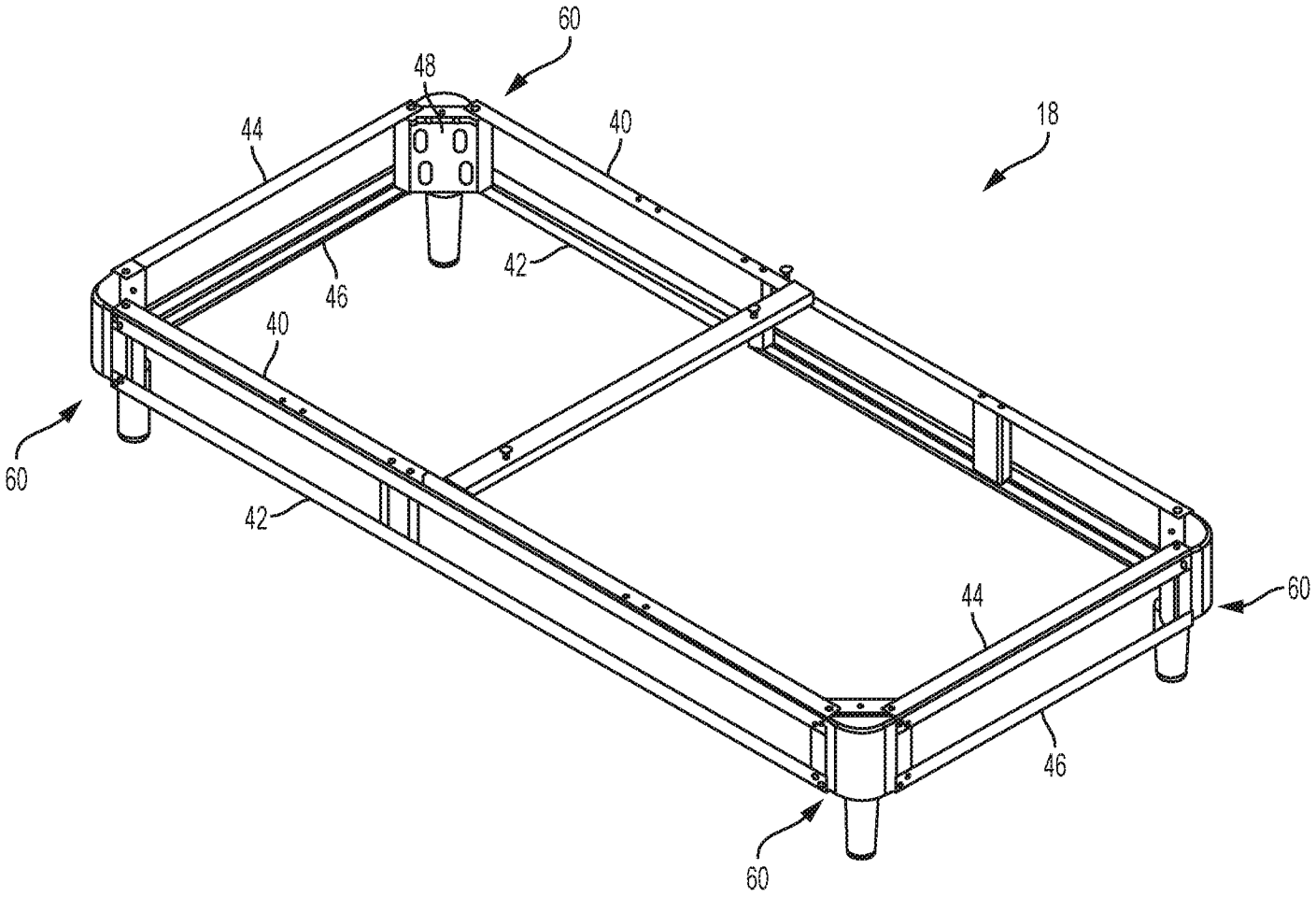
FIG. 3 is an isometric view of an adjustable foundation frame in accordance with the present disclosure.

As shown more clearly in FIG. 3, the generally rectangular foundation frame 18 generally includes upper and lower side frame members 40, 42 respectively, and upper and lower transverse frame members 44, 46, respectively. Respective ends of the upper and lower side frame members 40, 42 and the upper and lower transverse frame members 44, 46 are coupled to a corner bracket 48 to define the generally rectangular shape of the foundation frame 18. Adjustable support legs 60 (shown in FIG. 3) are coupled to the corner brackets 48 at each corner of the foundation for elevating the foundation 18 relative to ground.

Figure 4:
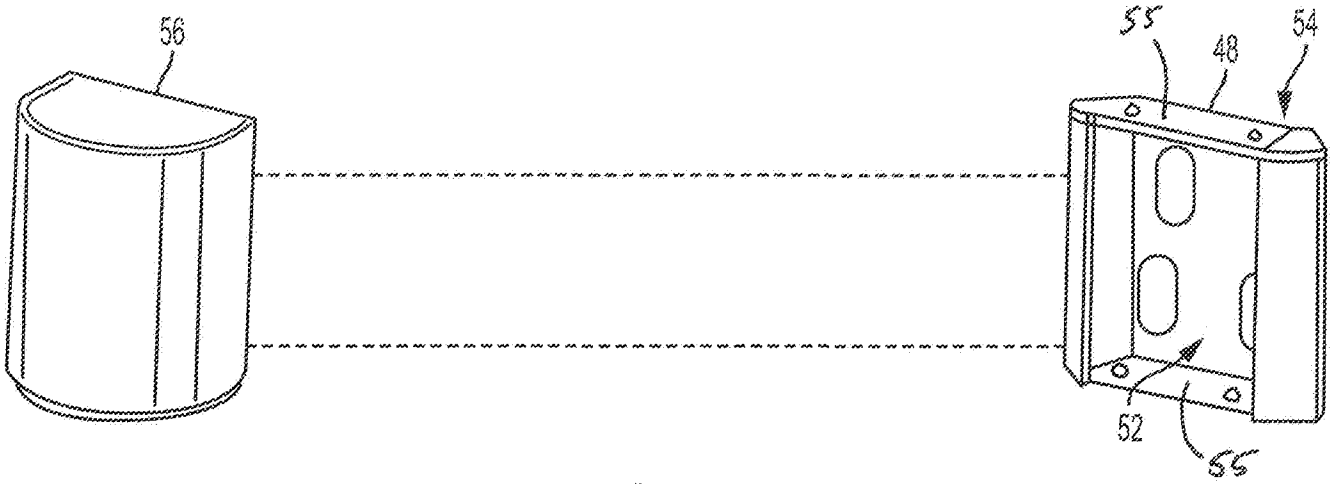
FIG. 4 is an exploded perspective view of a foam block and corner bracket arrangement in accordance with the present disclosure.

As shown in FIG. 4, the corner bracket 48 includes an exterior facing portion 52 and an interior facing portion 54. End surfaces 55 are configured for mechanical attachment of the respective ends of the upper and lower side frame members 40, 42 and the upper and lower transverse frame members 44, 46 so as to define a 90 degree relationship between the transverse frame members and the side frame members.

The exterior facing portion 52 is configured to receive an arcuate shaped foam block 56. End surfaces are configured for mechanical attachment to respective ends of a side frame member and a transverse frame member of the foundation frame at about a 45 degree angle relative to the interior facing portion and the exterior facing portion.

Figure 5:
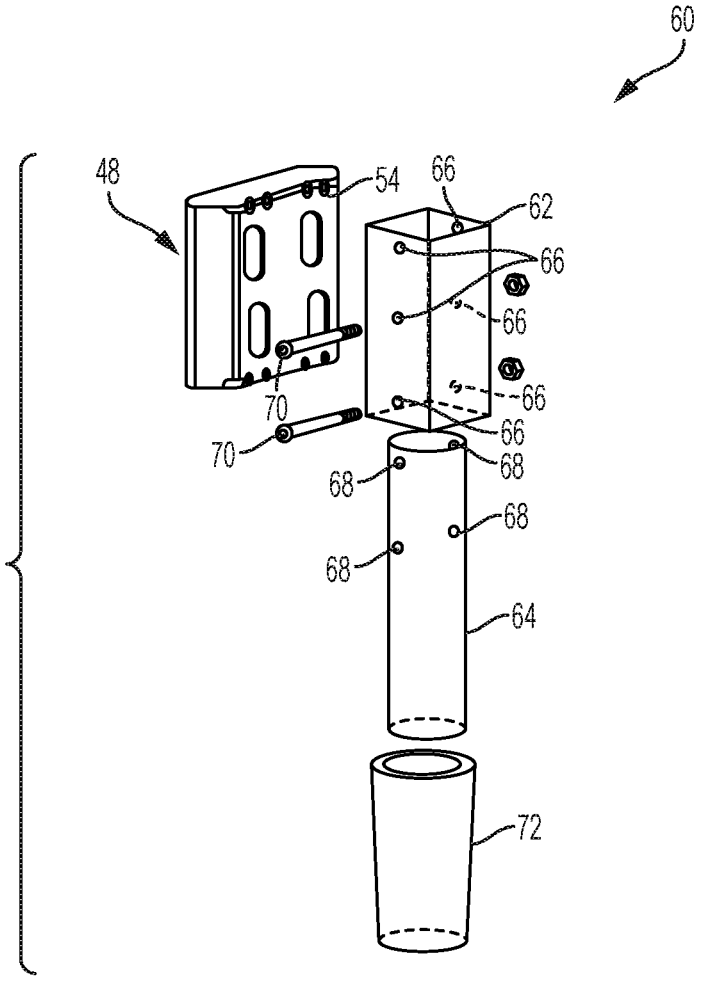
FIG. 5 is an exploded perspective view of a manually adjustable support leg in accordance with the present disclosure.

As shown in FIG. 5, the adjustable support leg 60 includes an outer tubular member 62 coupled to the interior facing portion 54 of the corner bracket 48. The outer tubular member 62 can be welded thereto or mechanically fastened. The tubular outer member 62 is shown having a square cross sectional shape, however, the tubular outer member can have a geometric cross section of any shape. The adjustable support legs 60 can be manually or automatically adjusted to provide different clearance heights.

For manual adjustment, each support leg 60 includes an inner tubular member 64 slidably engageable within the outer tubular member 62, wherein the cross sectional shape can vary from that of the outer tubular member 62 so long as the inner tubular member can be moved vertically with respect to the outer tubular member and lateral movement of the inner tubular member is substantially prevented. That is, the inner tubular member 64 is dimensioned to provide a close sliding fit within the outer tubular member 62.

A selected one of the inner and outer tubular members 64, 62, respectively, includes a plurality of linearly spaced apertures that generally correspond to a defined clearance height. The other one 62 or 64 can include at least one aperture, wherein a selected one of the plurality of linearly spaced apertures can be aligned with the at least one aperture so that a pin can be slidably engaged therewith so as to lock support legs 60 at a desired clearance height for the foundation 18. In FIG. 5, the outer tubular member 62 is configured with three linearly arranged and spaced apart apertures 66. The inner tubular member 64 is configured with two linearly arranged and spaced apart apertures 68, wherein a distance between the two linearly arranged and spaced apart apertures is equal to a distance between adjacent ones of the three linearly arranged and spaced apart apertures of the outer tubular member 62. When the respective apertures 66, 68 are aligned upon insertion of the inner tubular member 64 into the outer tubular member 62, a pin 70 can be inserted into the two aligned apertures 66, 68 to define a clearance height for the foundation 18 relative to ground.

In one or more embodiments, the pin 70 can be inserted through the outer tubular member 62. In these embodiments, a complementary plurality of apertures coaxially aligned with apertures 66, 68 are provided in a distal wall of the inner and outer tubular members. The manually adjustable support leg 60 may further include a decorative outer cover 72 as shown, which can be attached to the inner tubular member 64. Optionally, a caster can be attached to a bottom surface of the support leg.

In one or more other embodiments, the pin can be a depressible detent pin to maintain the selected clearance height. In this embodiment, the linearly and vertically spaced apertures are provided in the inner and outer tubular members as previously described. A channel can extend between each linear and vertical aperture of the outer tubular member and has a width less than the diameter of the pin. The inner tubular member includes the depressible detent pin, which further includes a leaf spring attached thereto that continuously urges detent pin in an outwardly direction so that when the inner tubular member is at a predefined height, the detent pin extends outwardly through the selected aperture of the outer tubular member so as to provide a locking relationship between the inner and outer tubular members. When the operator desires a different height, the detent pin can be depressed to slideably move the inner tubular member so as to engage a different selected aperture corresponding to a different clearance height.

Figure 6:
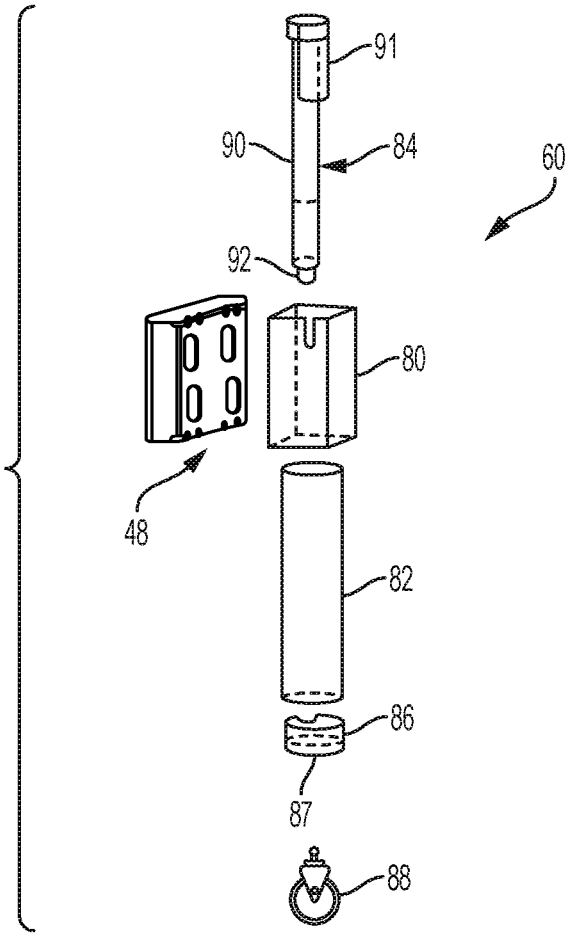
FIG. 6 is an exploded perspective view of an automatically adjustable support leg in accordance with the present disclosure.
Figure 7:
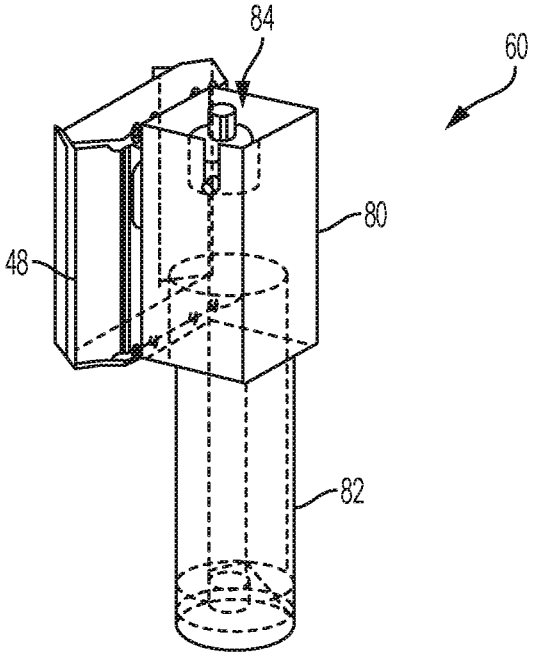
FIG. 7 is a perspective view of an automatically adjustable support leg in a retracted position in accordance with the present disclosure.
Figure 8:
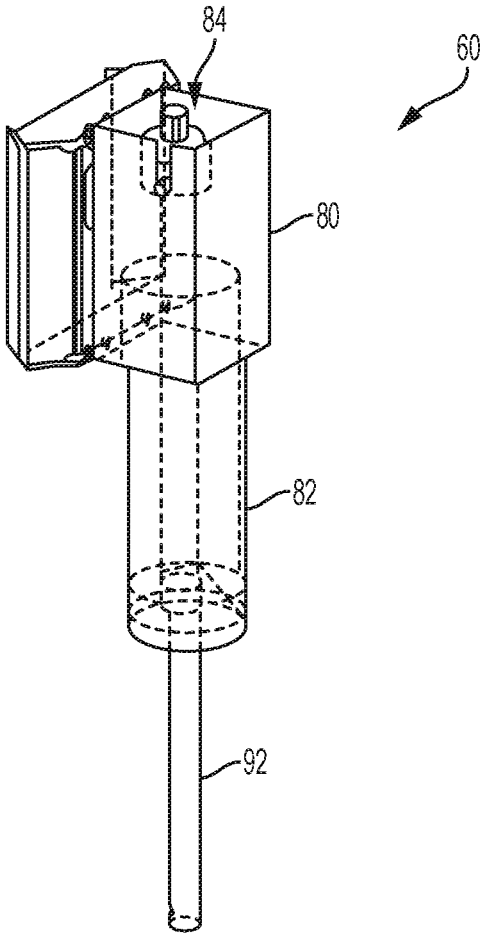
FIG. 8 is a perspective view of an automatically adjustable support leg in an extended position in accordance with the present disclosure.

Referring now to FIGS. 6-8, the support legs 60 can be configured to provide automatic adjustment. For automatic adjustment, the outer tubular member 80 is fastened to the corner bracket 48 as previously described. An inner tubular member 82 is fixedly attached at one end to the outer tubular member 80 and is non-movable relative to the outer tubular member 80. The inner tubular member 82 includes an endcap 86 at the other end. A linear actuator 84 is disposed within an interior region of and is fixedly attached to the outer tubular member 80. A portion of the linear actuator 84 extends into the interior region of the inner tubular member 82 and is coupled to the end cap 86, which includes an aperture 87. Each support leg 60 can further include a caster wheel 88 secured to the end cap 86.

The linear actuator can be a motorized mechanical linear force actuator and generally includes a cover tube 90 and motor 91 coupled thereto disposed within the outer tubular member 80. The linear actuator 84 further includes an extension tube 92 slideably engaged with cover tube 90 and actuated by the motor 91. A caster 88 may be disposed at a distal end of the extension tube.

FIGS. 7 and 8 depict the adjustable leg in the retracted and extended positions, wherein the extent of the extended position can be varied to provide a desired clearance height for the foundation at that particular support leg. The extension tube 92 has a diameter equal to the aperture 87 in the end cap 86. As previously described, all or individual support legs can be connected to a controller (not shown) to adjust the clearance height of the foundation. For example, two of the support legs along the longitudinal length of the foundation 18 can be extended to provide an end user with better access to underneath the foundation such as may be desired when vacuuming underneath the foundation.

In one or more embodiments, a process for ingress/egress from a mattress assembly including the adjustable support legs can include synchronization of two or more of the adjustable support legs so as to lower a height of the mattress. In this manner, ingress as well as egress can be easily facilitated. For example, the adjustable legs 60 along a longitudinal length of the foundation located at corners of the head section and the foot section, e.g., right hand side or left hand side or both, can be lowered to facilitate facile ingress and egress to/from the mattress. Once the user is situated on the mattress, the adjustable legs can be raised to provide the mattress in a horizontal position relative to ground or can be maintained at that position until such time the user decides to access the mattress.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A process for adjusting a height of a mattress, the process comprising:

lowering or raising adjustable support legs along a selected one of a longitudinal length of a foundation frame upon which a mattress is disposed, the adjustable support legs directly coupled to a corner bracket and configured to elevate the foundation frame relative to ground, wherein each corner bracket includes a planar surface defining an interior facing portion and an exterior facing portion, end surfaces configured for mechanical attachment to respective ends of a side frame member and a transverse member of the foundation frame at about a 45 degree angle relative to the interior facing portion and the exterior facing portion, and an arcuate foam block in a cavity provided in the exterior facing portion, wherein each of the adjustable support legs comprises an outer tubular member fastened to the planar surface of the interior facing portion of the corner bracket; and a motorized linear actuator coupled to the outer tubular member, the motorized linear actuator including a motor and an extendible portion coupled to the motor, wherein the extendible portion is configured to selectively retract from and extend from an inner tubular member mounted within the outer tubular member for adjusting the height of the foundation frame relative to ground.

* * * * *